United States Patent [19]

Huddleston

[11] 4,023,551

[45] May 17, 1977

[54] BOW STRING SILENCER

[76] Inventor: Marvin J. Huddleston, 485 W. Peak View Ave., Littleton, Colo. 80120

[22] Filed: Aug. 25, 1975

[21] Appl. No.: 607,240

[52] U.S. Cl. ..... 124/92; 273/DIG. 6

[51] Int. Cl.[2] ..... F41B 5/00

[58] Field of Search ..... 124/30 A, 24 R, 23 R, 124/92, 30 A; 273/DIG. 6

[56] References Cited

UNITED STATES PATENTS

| | | | |
|---|---|---|---|
| 3,059,629 | 10/1962 | Stinson | 124/30 A |
| 3,584,615 | 6/1971 | Stinson | 124/30 A |
| 3,612,029 | 10/1971 | Carroll | 124/30 A |
| 3,756,214 | 9/1973 | Christen | 124/23 R |

*Primary Examiner*—Richard C. Pinkham
*Assistant Examiner*—William R. Browne
*Attorney, Agent, or Firm*—Phillip L. DeArment

[57] ABSTRACT

Preferably two bow string silencers, each comprising an elongated rectangular strip of flat flexible, resilient material having a multi-point contact with a bow string and including a multiplicity of discrete energy dissipating members formed along the opposite elongated sides are attached to each bow string. The silencers have very small volume and weight and are constructed from high strength material so as not to interfere with the throw of the arrow, can be readily adjustable along the bow string to locate for maximum energy attenuation and will resist being torn off by repeated throwing of arrows.

10 Claims, 4 Drawing Figures

BOW STRING SILENCER

BACKGROUND OF THE INVENTION

Hunting game with a bow and arrow requires the hunter to exercise considerable cunning and skill to get in close range to the animal without being detected. Once in close range, the throwing of the arrow must be accomplished as quietly as possible so that the animal remains stationary until the arrow arrives.

Of particular concern to the hunter is the noise made by the bow string in throwing the arrow. The noise is caused by harmonics set up in the vibrating bow string. The prior art has provided several proposed solutions to reduce bow string noise. The known prior art suggests variously configured devices (see for example, U.S. Pat. Nos. 3,059,629, 3,584,615, 3,612,029 and 3,756,214) adapted to be mounted on the bow strings in various ways. The prior art has the following disadvantages as bow string silencers: (a) difficult to mount, secure and adjust on the bow strings, (b) volume and weight interfere with normal operation including throwing accuracy of the arrow, (c) they do not appreciatively reduce bow string noise. (d) they are easily thrown off bow strings, and (e) the complex configurations proposed makes the manufacturing costs of these devices relatively high.

The present invention has as an object to provide a bow string silencer that does not have the aforementioned disadvantages.

Specifically, the present invention has as an object to provide a simple, strong, easy to mount and adjust, small and strong bow string silencer that lasts for a relative long time and provides effective attenuation of acoustical energy.

This and other objects will become more apparent when considering the following detailed description of the invention made in conjunction with the drawing and in which.

Figure 1:
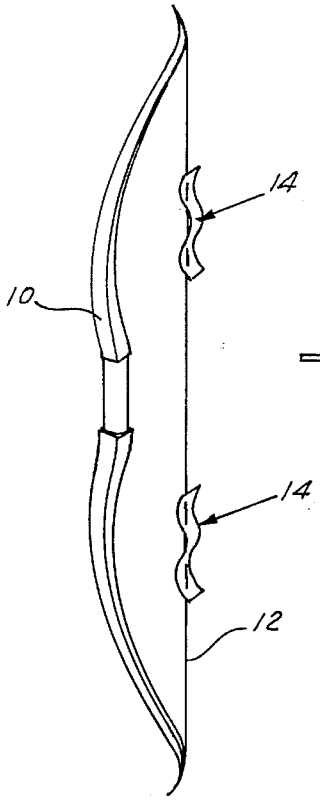
FIG. 1, is a perspective view of a bow and arrow with bow string silencers mounted thereon.

The bow string silencer according to the present invention is indicated generally by the reference numeral 14 and is adapted to be used in conjunction with the typical bow 10 having a bow string 12 connected thereto. In use, the bow string vibrates when it is released by the archer in the course of casting or throwing an arrow. This vibration sets up harmonics in the string which generates noise audibly, for example, to game animals. Due to the difference in speed of sound and the travel of the arrow, the animal may avoid the arrow by moving upon hearing the sound generated by the bow string.

Figure 2:
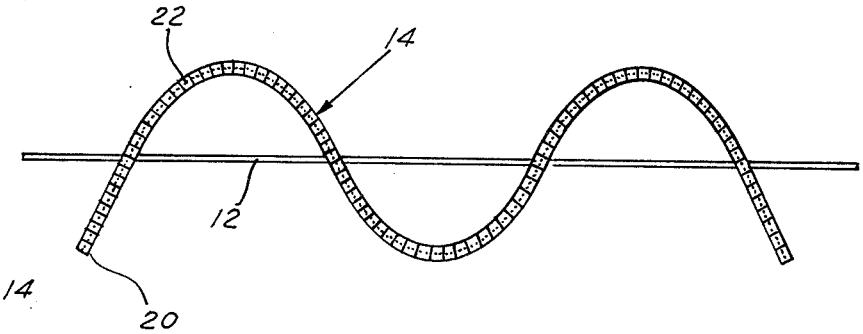
FIG. 2, is an elevational view of a silencer according to the present invention as it is mounted on a bow string.
Figure 3:
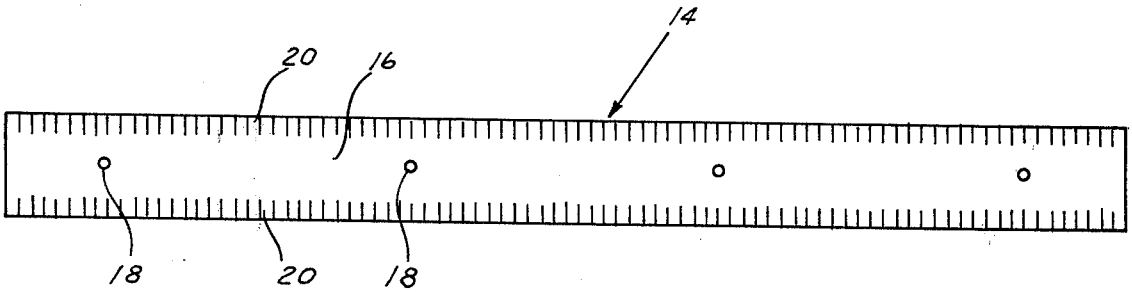
FIG. 3, is a plan view of the silencer according to the present invention.

The bow string silencer 14 comprises an elongated, general rectangular-shaped member which comprises a flat body portion 16. The body portion 16 is connected to the bow string through a plurality of openings or holes 18 which are spaced longitudinally along the central portion of the body portion 16 as best illustrated in FIG. 3. The silencer 14 is mounted on the bow string 12 by threading the bow string 12 through holes 18 such that the silencer assumes a general configuration on the bow string 12 as illustrated in FIG. 2.

Figure 4:
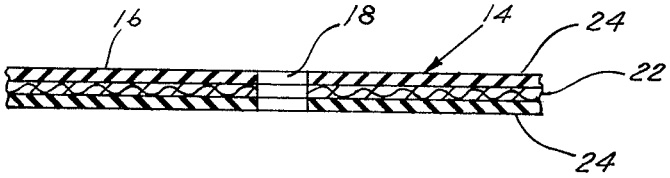
FIG. 4, is a sectional view taken through a portion of the silencer.

The vibrations set up in bow string 12 are transmitted to the silencer 14 through the area defining the holes 18 and thus can be considered as the energy transfer areas. The energy transfer to the body portion 16 begins to be dissipated by the extremely flexible nature of the body portion 16. The energy is then transferred by the body portion 16 lengthwise therethrough and transversely where it is finally dissipated by a multiplicity of energy dissipating members or fingers 20. Members 20 are preferably formed by cutting slots along the opposite longitudinal sides of the body portion as illustrated in FIG. 3. Each of these discrete energy dissipating members are, integral with the body portion and their ends are free to move relatively to the body portion and by so moving effects dissipation of the acoustical energy. The silencer 14 should be constructed from very strong energy dampening and flexible material. As illustrated in FIG. 4, the preferred material is a composition of a nylon substrate 22 upon which is bonded layers of neoprene 24. This particular composition has been found to exhibit excellent noise attenuation characteristics and possess the requisite strength to prevent the silencer 14 from being thrown off the bow string 12 in the course of casting arrows.

This particular material composition also provides a very lightweight silencer which provides minimal interference with the normal operation of the bow including accuracy of the cast arrow.

The effectiveness of the silencer 14 according to the present invention has been demonstrated by series of scientific tests. These tests were conducted by strategically placing acoustical instruments about a fixed bow and measuring the noise generated by the bow with and without the silencer. This data is presented in the following chart:

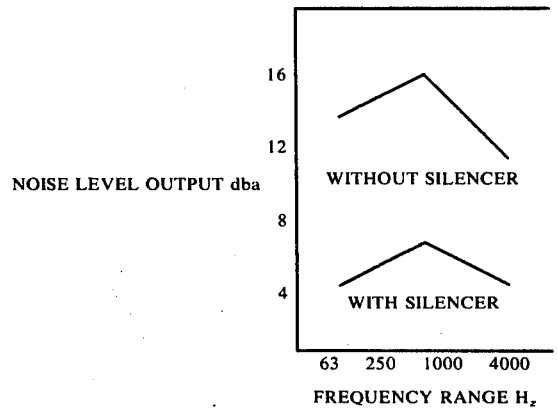

The silencer 14 when mounted on the bow string may have to be tuned by moving the silencer in various positions until the best sound attenuation is found. The extreme lightweight, (approximately 23 grains) and small volume (approximately 4 inches by 0.50 inches by 3/64 inches), provides minimal interference with the normal function of the bow. The silencer 14 is also easy to mount on the bow string and due to the threading action through the silencer stays where positioned on the bow string. The silencer attributes are enhanced considerably by the very large number of members or fingers 20. There are an excess of 100 discrete members on each silencer.

It should be apparent that the silencer according to the present invention satisfies the objectives for an effective bow string silencer and the simple configuration provides a relatively low manufacturing cost.

Having described my invention, I claim:

1. An archery bow string silencing device adapted to be mounted on a bow string and reduce the acoustical energy or noise generated in the course of throwing an arrow comprising a relatively flat, flexible body portion of small volume and weight, means defining a plurality of energy transfer areas spaced along said flexible body portion and engageable with spaced portions of a bow string and operable to transfer energy from several locations along a bow string to said body portion, and a plurality of discrete energy dissipating members in energy transfer relationship with and projecting from said body portion, each of said members being connected at one end to said body portion and the opposite end being free to move relative to said body portion to dissipate the energy transferred thereto from said body portion.

2. The silencing device as defined in claim 1, wherein said means defining a plurality of energy transfer areas includes a plurality of holes formed centrally along said body portion and having diameters approximating the diameter of a bow string so that a bow string can be threaded through said spaced holes to effect multiple adjustable friction connection between the silencing device and bow string.

3. The silencing device as defined in claim 2, wherein there are four spaced holes along said body portion.

4. The silencing device as defined in claim 1, wherein said silencing device is rectangular in plan and has a relatively small thickness and said discrete members are formed by cuts made along the opposite longitudinal edge portions of said body portion.

5. The silencing device as defined in claim 4, wherein said means defining a plurality of energy transfer areas includes a plurality of holes longitudinally spaced along the central portion of said body portion, said holes having diameters approximating the diameter of a bow string whereby the bow string may be threaded through said spaced holes.

6. The silencing device as defined in claim 4, wherein said body portion and discrete members are formed from material comprising neoprene layers laminated onto each side of a nylon substrate.

7. An archery bow string silencing device comprising an elongated rectangular body portion having integrally formed, discrete energy dissipating members along the opposite longitudinal edge portions and a plurality of holes longitudinally spaced along the central portion of said body portion and having diameters approximating a bow string diameter such that a bow string can be threaded through the holes to connect a body portion to the bow string in a frictional fit relationship but which permits adjustment of a device along the bow string.

8. The silencing device as defined in claim 7, wherein the device is constructed from material comprising neoprene laminated onto opposite sides of a nylon substrate.

9. The silencing device as defined in claim 7, wherein said holes consist of four holes.

10. The silencing device as defined in claim 9, wherein there are in excess of 100 discrete members.

* * * * *